US010212771B2

(12) United States Patent
Loomis et al.

(10) Patent No.: US 10,212,771 B2
(45) Date of Patent: Feb. 19, 2019

(54) BRIGHTNESS CONTROL SYSTEM FOR DECORATIVE LIGHT STRINGS

(71) Applicant: Seasons 4, Inc., Toano, VA (US)

(72) Inventors: Jason Loomis, Decatur, GA (US); Fred Schleifer, Spencer, NY (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 15/722,841

(22) Filed: Oct. 2, 2017

(65) Prior Publication Data

US 2018/0124881 A1 May 3, 2018

Related U.S. Application Data

(63) Continuation-in-part of application No. 15/087,064, filed on Mar. 31, 2016, now Pat. No. 9,781,796.

(51) Int. Cl.
*H05B 37/02* (2006.01)
*H05B 33/08* (2006.01)

(52) U.S. Cl.
CPC ..... *H05B 33/083* (2013.01); *H05B 33/086* (2013.01); *H05B 33/0815* (2013.01);
(Continued)

(58) Field of Classification Search
CPC ..... H05B 33/0815; H05B 33/0842; H05B 33/0857; H05B 37/029; H05B 37/0227; H05B 37/0245; H05B 37/0272
(Continued)

(56) References Cited

U.S. PATENT DOCUMENTS 6,150,802 A 11/2000 Andrews
6,157,139 A * 12/2000 Gibboney, Jr. ..... H02H 9/02 315/185 R (Continued)

FOREIGN PATENT DOCUMENTS

DE 102006026938 A1 12/2007
EP 2337207 A2 6/2011
GB 2490887 A 11/2012

OTHER PUBLICATIONS

Extended European Search Report, for European Patent Application No. 17164189.7, dated Aug. 8, 2017, 7 pages.

*Primary Examiner* — Tung X Le
(74) *Attorney, Agent, or Firm* — Kinney & Lange, P.A.

(57) ABSTRACT

Apparatus and associated methods relate to providing a constant-brightness lighting power to one or more interconnected light strings. A light string power controller draws operating power from a power source that has a variable voltage. The light string power controller supplies constant-brightness lighting power to the one or more interconnected light strings connected thereto. The power controller can send a load-query signal the one or more interconnected light strings connected thereto. The connected light strings respond to the query with a load-response signal, which is indicative of a power level corresponding to an illumination value of the one or more interconnected light strings. The load-response signal can be indicative of a total number of lighting elements of the one or more interconnected light strings, for example. Similarly, the load-response signal can be indicative of a desired power level for a predetermined illumination level of the one or more interconnected light strings.

19 Claims, 7 Drawing Sheets

(52) U.S. Cl.
CPC ..... *H05B 33/0842* (2013.01); *H05B 33/0848* (2013.01); *H05B 33/0857* (2013.01); *H05B 37/0263* (2013.01)

(58) Field of Classification Search
USPC ..... 315/185 R, 192, 193, 294, 312
See application file for complete search history.

(56) References Cited

U.S. PATENT DOCUMENTS

| | | | | |
|---|---|---|---|---|
| 7,852,011 | B2 | 12/2010 | Peng | |
| 8,007,129 | B2 | 8/2011 | Yang | |
| 9,699,845 | B2 * | 7/2017 | Hagino | H05B 33/0815 |
| 2005/0068459 | A1 | 3/2005 | Holmes et al. | |
| 2009/0045941 | A1 | 2/2009 | Cooper | |
| 2011/0254462 | A1 | 10/2011 | Ruan et al. | |
| 2011/0285299 | A1 | 11/2011 | Kinderman et al. | |
| 2012/0223648 | A1 * | 9/2012 | Jin | H05B 33/0815 315/186 |
| 2012/0229032 | A1 | 9/2012 | Van De Ven et al. | |
| 2014/0168567 | A1 * | 6/2014 | Kikuchi | H05B 33/0815 349/61 |
| 2014/0184080 | A1 * | 7/2014 | Rybicki | H05B 33/0845 315/122 |
| 2015/0102731 | A1 | 4/2015 | Altamura et al. | |
| 2017/0280528 | A1 * | 9/2017 | Urry | F21V 23/0435 |

* cited by examiner

BRIGHTNESS CONTROL SYSTEM FOR DECORATIVE LIGHT STRINGS

BACKGROUND

Decorative light strings are used to communicate a joy of a holiday season, to draw attention to merchandise, or to simply decorate or adorn an object. Decorative light strings have been used to adorn trees, shrubs, and houses. Decorative light strings are used both indoors and outdoors. In some lighting situations, power sources for such decorative light strings are difficult to tap or unavailable altogether. In such lighting situations, batteries can be used to provide power to light strings and to other decorative lights.

Batteries, however, may have a power supply capability that changes in response to changes in battery charge, ambient temperature, number of charge cycles, etc. When used to provide lighting power to decorative light strings, variations in the power supply capability of batteries can be manifest by variations in brightness of the decorative light strings. For example, the brightness of the decorative light string may decrease in response to charge depletion of the battery over time. The decorative light string may thus become less decorative over time.

SUMMARY

Apparatus and associated methods relate a system for providing constant-brightness to light elements of one or more connected decorative light strings. The system includes a light-string load detector configured to provide, via an electrically-conductive path, a load-query signal to the one or more a connected light strings. The light-string load detector is further configured to detect, via the electrically-conductive path, a load-response signal from the one or more connected decorative light strings. The load-response signal is indicative of a power level corresponding to an illumination value of the one or more connected decorative light strings. The system also includes a power converter configured to draw operating power from a power source. The power converter is further configured to provide, via the electrically-conductive path, power to the one or more connected decorative light strings. The power is provided at the power level indicated by the detected load-response signal.

Some embodiments relate to a decorative light string configured for use with a modular constant-brightness lighting system. The decorative light string includes a first electrical connector located at a first end of the decorative light string. The first electrical connector has first and second contacts. The first electrical connector is configured to receive power via the first and second contacts of the first electrical connector. The decorative light string includes a second electrical connector at a second end of the decorative light string. The second electrical connector has first and second contacts. The second electrical connector is configured to provide power via the first and second contacts of the second electrical connector. The decorative light string includes a first conductor electrically coupled to and extending between the first contact of the first electrical connector and the first contact of the second electrical connector. The decorative light string includes a second conductor electrically coupled to and extending between the second contact of the first electrical connector and the second contact of the second electrical connector. The decorative light string includes a plurality of lighting elements distributed along the decorative light string and configured to receive operating power via the first and second conductors. The decorative light string also includes a load-query responder electrically connected between the first and second conductors. The load-query responder is configured to receive a load-query signal and to provide a load-response signal in response to the received load-query signal. The load-response signal is indicative of a power level corresponding to an illumination value of the plurality of lighting elements.

Some embodiments relate to a battery module. The battery module includes a battery receiver configured to receive one or more batteries. The battery module includes an input power connector configured to mechanically and electrically couple to an upstream battery module in a series fashion. The battery module includes an output connector configured to mechanically an electrically couple to either a downstream battery module in a series fashion or to a modular constant-brightness lighting system. If the battery module is connected to the modular constant-brightness lighting system, power is provided to the constant-brightness light controller, the provided power having a voltage equal to the sum of voltages provided by connected upstream battery modules and voltage of the battery module connected to the modular constant-brightness lighting system.

DETAILED DESCRIPTION

Figure 1:
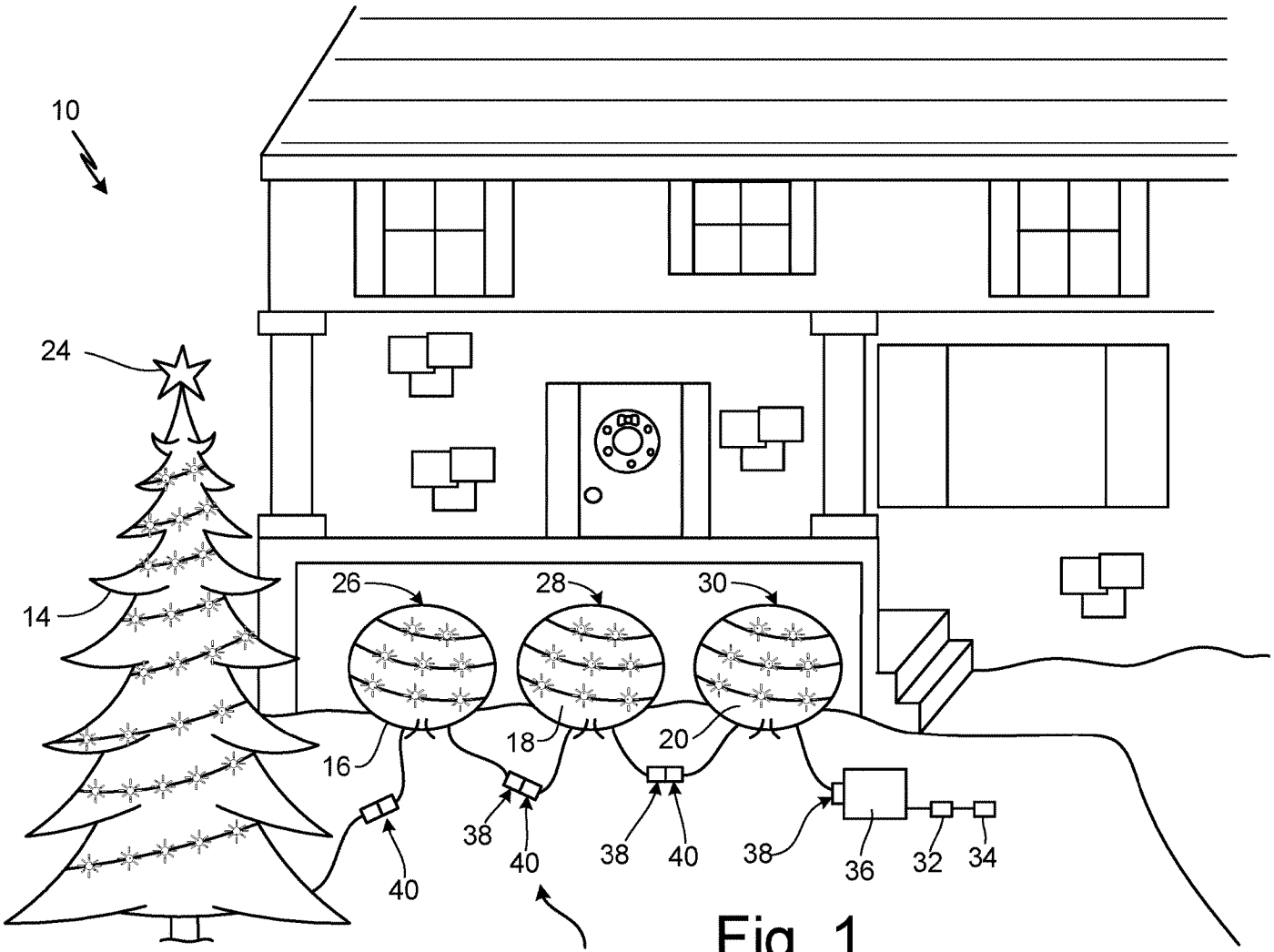
FIG. 1 is a schematic view of a home decorated with various decorative light strings controlled by an exemplary lighting controller providing for constant brightness.

FIG. 1 is a schematic view of a home decorated with various decorative light strings controlled by an exemplary lighting controller providing for constant brightness. In FIG. 1, home 10 has garden 12 with tree 14 and shrubs 16, 18, 20. Tree 14 is decorated with decorative light string 22 and decorative illuminated star 24. Shrubs 16, 18, 20 are decorated with decorative light strings 26, 28, 30, respectively. Battery modules 32, 34 are interconnected with each other, and battery modules 32, 34 are coupled to lighting controller 36. Decorative light strings 22, 26, 28, 30 and decorative illuminated star 24 are interconnected with one another, and interconnected decorative light strings 22, 26, 28, 30 and decorative illuminated star 24 are coupled to lighting controller 36.

Lighting controller 36 may have an internal power source, but can also draw operating power from battery modules 32, 34 coupled to lighting controller 36. Lighting controller 36 can provide constant-brightness lighting power to interconnected decorative light strings 22, 26, 28, 30 and decorative illuminated star 24. Each of interconnected decorative light strings 26, 28, 30 is depicted as having first light-string connector 38 and second light-string connector 40 on opposite ends of light strings 26, 28, 30. First light-string connectors 38, second light-string connector 40 or both first and second light-string connectors 38, 40 may have additional connection ports to which additional light strings or other decorative lighting elements can be connected.

If additional decorative lighting elements are connected to interconnected decorative light strings 22, 26, 28, 30 and decorative illuminated star 24, then lighting controller 36 adaptively provides additional power to the interconnected decorative light strings 22, 26, 28, 30 and decorative illuminated star 24 having such additional decorative lighting elements. Lighting controller 36 can sense a power drawn by interconnected decorative light strings 22, 26, 28, 30 and decorative illuminated star 24 having such additional decorative lighting elements. Lighting controller 36 can then source additional power to interconnected decorative light strings 22, 26, 28, 30 and decorative illuminated star 24 having such additional decorative lighting elements.

The amount of additional power sourced by lighting controller 36 is sufficient to maintain a constant brightness of interconnected decorative light strings 22, 26, 28, 30 and decorative illuminated star 24. In other words, the power level provides by lighting controller 36 to light strings 22, 26, 28, 30 and decorative illuminated star 34 is maintained even though additional lighting elements are added. This maintained power level to light strings 22, 26, 28, 30 and decorative illuminated star 34 is achieved by lighting controller 36 sourcing additional lighting power.

Figure 2:
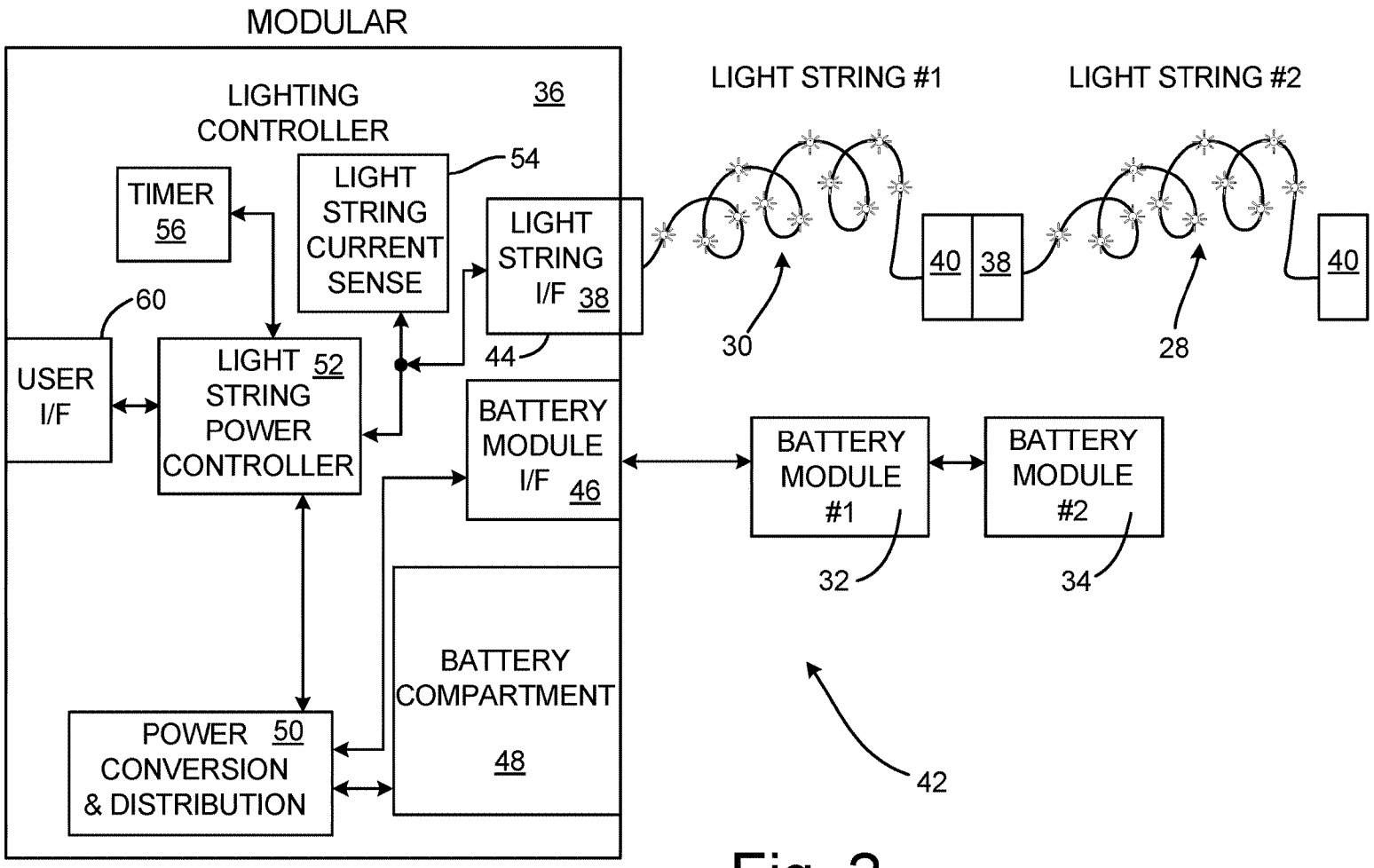
FIG. 2 is a block diagram of an exemplary modular lighting system.

FIG. 2 is a block diagram of an exemplary modular lighting system. In FIG. 2 modular lighting system 42 include lighting controller 36, first light-string 30, second light string 28, first battery module 32, and second battery module 34. First and second light strings 30, 28 are interconnected one to another. First and second light string 30, 28 each has first light-string connector 38 and second light-string connector 40. Second light-string connector 40 of first light string 30 is electrically connected to first light-string connector 38 of second light string 28.

First and second battery modules 32, 34 are interconnected to one another in a similar manner to the manner in which first and second light strings 30, 28 are interconnected to one another. In some embodiments, battery modules 32, 34 can be interconnected in a serial fashion. In some embodiments, battery modules 32, 34 can be interconnected in a parallel fashion. In some embodiments, battery modules 32, 34 can be interconnected in a daisy-chain fashion.

Lighting controller 36 includes: light string interface 44; battery module interface 46, battery compartment 48; power conversion and distribution module 50; light string power controller 52; light string current sense module 54; timer 56; and user interface 60. Interconnected first and second light strings 30, 28 are connected to lighting controller 36 via light string interface 44 and first light-string connector 38 of first light string 30. Interconnected first and second battery modules 32, 34 are connected to lighting controller 36 via battery module interface 46.

Battery compartment 48 can receive one or more batteries. Power conversion and distribution module 50 receives power from interconnected first and second battery modules 32, 34 or from battery compartment 48 or from both interconnected first and second battery modules 32, 34 and battery compartment 48. Power distribution and control module 50 then generates one or more supply levels for use by various components of lighting controller 36.

Light string power controller 52 receives operating power from power conversion and distribution module 50. Light string power controller 52 provides constant-brightness lighting power to interconnected first and second light strings 30, 28 via light string interface 44. The constant-brightness lighting power is substantially independent of a first voltage that varies with a charge of a battery received in battery compartment 48, and independent of a second voltage that varies with a charge of first and second battery modules 32, 34, and independent of a number (e.g., two in the depicted embodiment), up to a predetermined maximum number, of interconnected light strings connected to the light-string connector. In some embodiments, the predetermined maximum number of interconnected light strings to which lighting module 36 can supply constant-brightness lighting power is constrained by a maximum power rating of light string power controller 52. In various embodiments the maximum power rating of light string power controller 52 is capable of providing illuminative power to 2, 3, 5, 8 or 10 light strings.

Constant-brightness lighting power is defined to mean lighting power that is within a limited range of predetermined power level. For example, constant-brightness lighting power can mean a lighting power within plus or minus 15%, 10%, 6%, or about 3% of a target lighting power, for example. In some embodiments, constant-brightness lighting power can mean lighting voltage within plus or minus 12%, 10%, 5%, or about 3% of a target lighting voltage, for example.

Light string current sensor 54 can sense a current drawn by interconnected first and second light strings 30, 28. Light string current sensor can then generate a signal indicative of the sensed current drawn by interconnected first and second light strings 30, 28. Light string current sensor can then output the generated signal indicative of the sensed current drawn by interconnected first and second light strings 30, 28 to light string power controller 52. Light string power controller 52 can then change, if necessary, a lighting power so as to maintain the constant-brightness lighting power provided to the first and second light strings 30, 28.

Such adaptive control of lighting power can maintain constant brightness of first and second light strings 30, 28 even should some LEDs of first and second light strings fail. Such adaptive control of lighting power can maintain constant brightness of first and second light strings 30, 28 even should additional light strings be added. Such adaptive control of lighting power can maintain constant brightness of first and second light strings 30, 28 even should one of first and second light strings 30, 28 be removed.

Adaptive control of lighting power has other advantages. For example, adaptive control of lighting power can maintain a constant brightness of light strings 30, 28 through changes in an ambient temperature. For example, a current-voltage relation in a light string can change in response to a changing ambient temperature. If the current-voltage relation of a light string changes, open loop power control can result in non-constant brightness of the light string. But by sensing both a current drawn by the light string and a voltage across the light string, a power can be measured. In some embodiments, the power can then be adaptively controlled to maintain constant brightness in the light string.

Timer 56 can generate timing signals and provide such timing signals to light string power controller 52. Light string power controller 52 can respond to such timing signals, for example, by turning on first and second light strings 30, 28, turning off first and second light strings 30, 28, dimming first and second light strings 30, 28, etc. Such timing signals may be used to change colors of first and second light strings 30, 28, for example. In some embodiments, such timing signals may be used to make first and second light strings 30, 28 flash on and off in some predetermined fashion. Timer 56 may generate a command signal indicative of a specific lighting command and/or function.

User interface 60 may include user output devices and/or user input devices. Examples of output devices can include a display device, a sound card, a video graphics card, a speaker, a cathode ray tube (CRT) monitor, a liquid crystal display (LCD), a light emitting diode (LED) display, an organic light emitting diode (OLED) display, or other type of device for outputting information in a form understandable to users or machines. Examples of input device(s) 48 can include a mouse, a keyboard, a microphone, a camera device, a presence-sensitive and/or touch-sensitive display, or other type of device configured to receive input from a user.

In some embodiments, user interface 60 may be in a form of a communications port. User interface 60, in one example, utilizes one or more communication devices to communicate with external devices via one or more networks, such as one or more wireless or wired networks or both. User interface 60 can be a network interface card, such as an Ethernet card, an optical transceiver, a radio frequency transceiver, or any other type of device that can send and receive information. Other examples of such network interfaces can include Bluetooth, 3G, 4G, and WiFi radio computing devices as well as Universal Serial Bus (USB).

Figure 3:
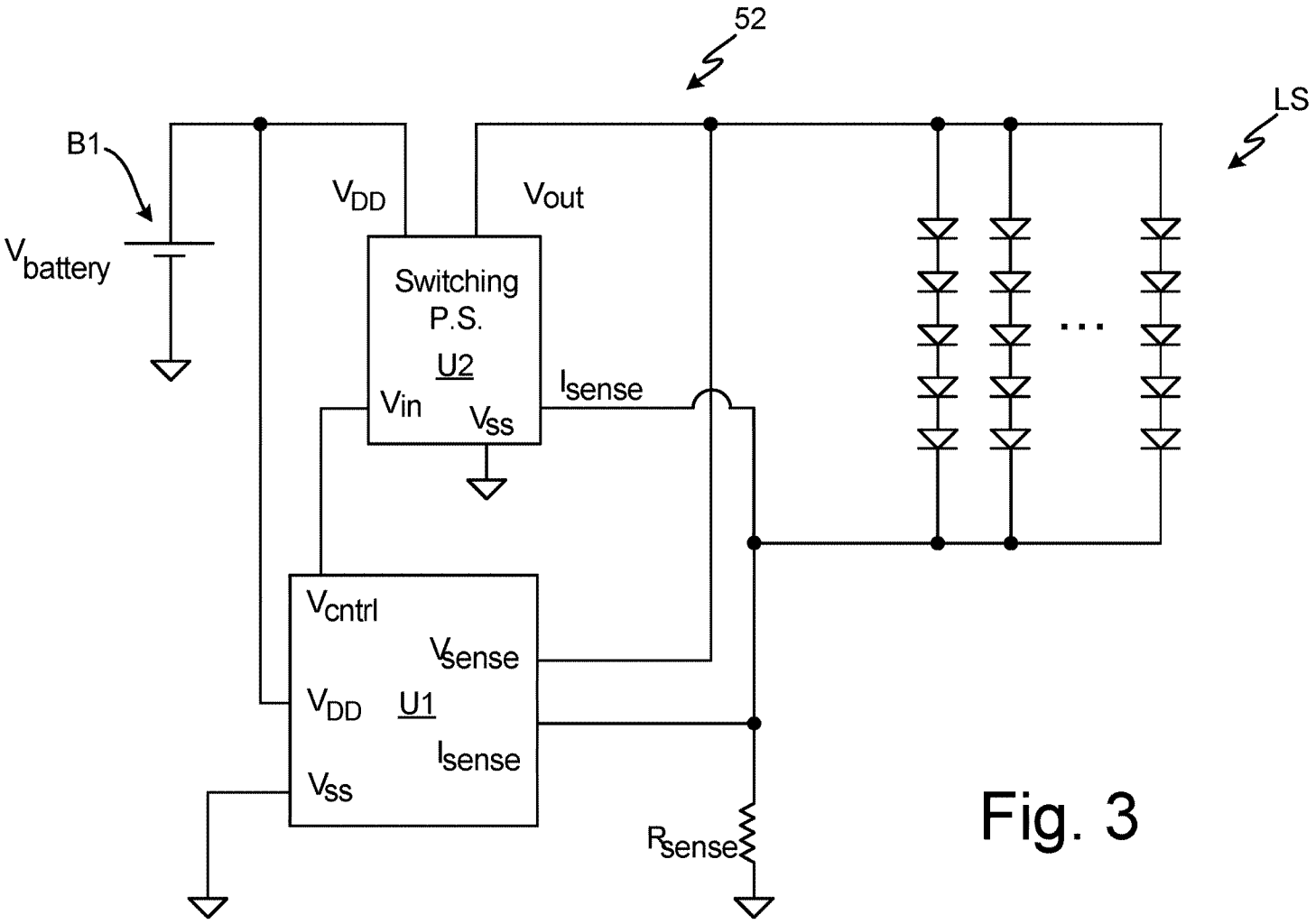
FIG. 3 is a circuit schematic diagram of an exemplary constant-brightness decorative lighting system.

FIG. 3 is a circuit schematic diagram of an exemplary constant-brightness decorative lighting system. In FIG. 3, light string power controller 52 includes battery B1, LED lighting controller U1, switching power supply U2, current sense resistor $R_{SENSE}$, and light string LS. Output $V_{OUT}$ of switching power supply U2 provides operating power to light string LS. Output $V_{OUT}$ of switching power supply U2 is also coupled to node $V_{SENSE}$ of LED lighting controller U1. A voltage across current sensing resistor $R_{SENSE}$ is indicative of the current through light string LS. The voltage across $R_{SENSE}$ is provided to node $I_{SENSE}$ of LED lighting controller U1 and node $I_{SENSE}$ of switching power supply U2. In some embodiments, switching power supply U2 uses the $I_{SENSE}$ signal for fast, closed-loop control of the LED current. In some embodiments, lighting controller U1 uses the signal for fine-tuning of the LED current and/or to detect low-battery charge conditions.

LED lighting controller U1 generates control signal $V_{CTRL}$, based on the signals received on nodes $V_{SENSE}$ and/or $I_{SENSE}$. The generated control signal $V_{CTRL}$ is then output to input pin $V_{IN}$ of switching power supply U2. Control signal $V_{CTRL}$ is indicative of a desired lighting power. Switching power supply U2 receives the control signal $V_{CTRL}$ indicative of the desired lighting power on node $V_{IN}$. Switching power supply U2 generates a constant-brightness lighting power and supplies the constant-brightness lighting power to light string LS via output node $V_{OUT}$. Both switching power supply U2 and LED lighting controller U1 receive operating power from battery B1.

Various embodiments can use various means for providing constant-brightness lighting power to an interconnected number of light strings. In some embodiments, light string power controller 52 can generate and provide constant-brightness lighting power. In some embodiments, light string power controller 52 can include any one or more of a microprocessor, a controller, a digital signal processor (DSP), an application specific integrated circuit (ASIC), a field-programmable gate array (FPGA), or other equivalent discrete or integrated logic circuitry. In some embodiments, light string power controller 52 may generate a digital signal indicative of a constant-brightness lighting power. A digital-to-analog converter can then convert the digital signal indicative of the constant-brightness lighting power to an analog power signal supplying the constant-brightness lighting power.

Figure 4:
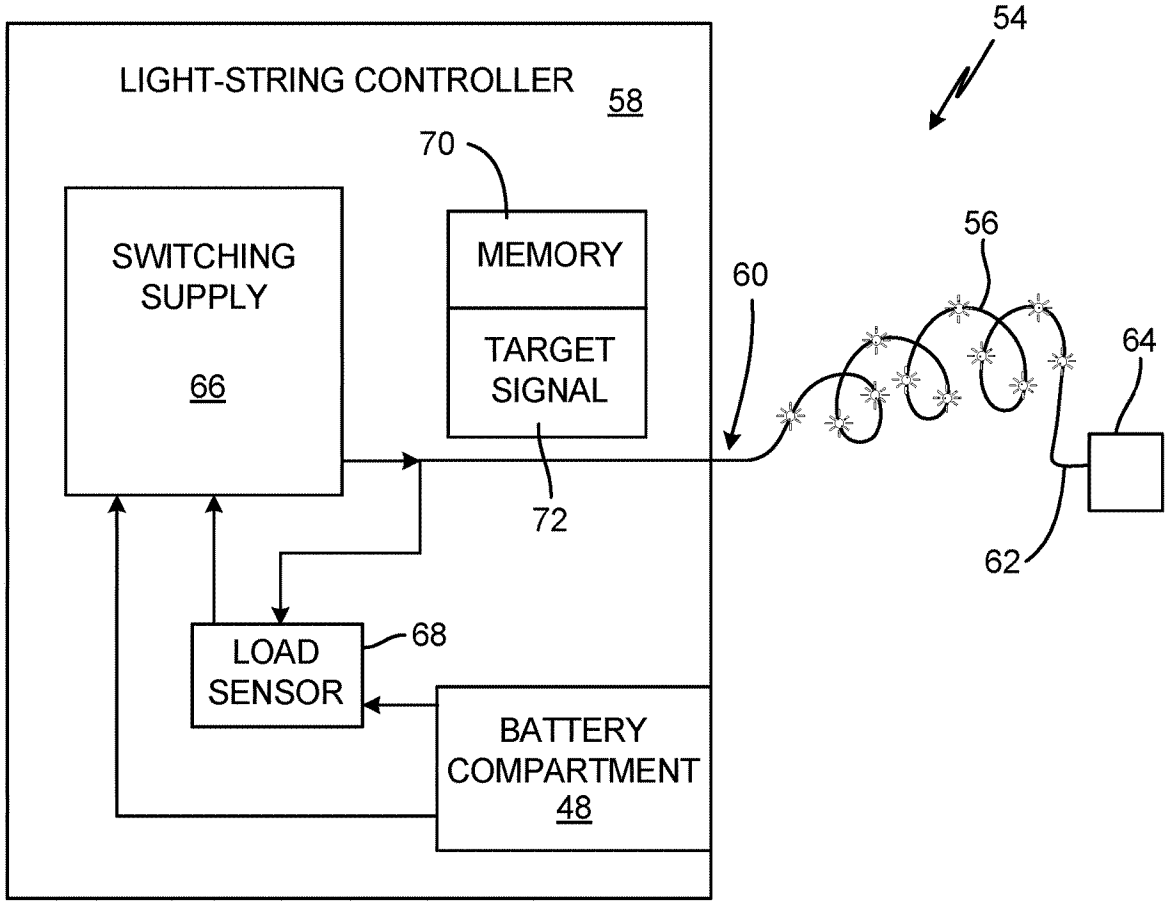
FIG. 4 is a block diagram of an exemplary constant-brightness decorative lighting system.

FIG. 4 is a block diagram of an exemplary constant-brightness lighting system. The constant-brightness lighting system depicted in FIG. 4 is a simplified version compared with the modular lighting system depicted in FIG. 2. In FIG. 4, constant-brightness lighting system 54 includes light string 56 and light-string controller 58. Light string 56 is connected to light-string controller 58 at first end 60 of light string 56. At second end 62 of light string 56 is light string connector 64. Light string connector 64 is configured to connect to additional interconnected lighting elements.

Light-string controller 58 has battery compartment configured to receive one or more batteries. The received batteries can provide operating power to light-string controller 58 which provides a portion of such operating power to light string 56 in the form of lighting power. Light-string controller 58 includes switching supply 66, load sensor 68, and memory module 70. Switching supply 66 and load sensor 68 are in electrical communication with light string 56. Load sensor 68 is configured to sense a signal indicative of a brightness of light string 56. Load sensor 68 may provide the sensed signal indicative of the brightness of light string 56 to switching supply 66. In some embodiments, load sensor 68 can generate a new signal indicative of the brightness of light string 56 and provide the generated new signal to switching supply 66. For example, load sensor may amplify and/or filter the sensed signal before providing the generated new signal to switching supply 66.

Switching supply 66 can compare the received signal indicative of the brightness with a target signal 72. Target signal 72 can be retrieved from memory 58 and/or it can be calculated by switching supply 66. In some embodiments, target signal 72 can be calculated based on the received signal indicative of the lighting brightness. For example, the signal indicative of the lighting brightness may include a signal indicative of a number of lighting elements. The target brightness may be calculated to vary in response to the number of lighting elements, for example. For example, a sensed voltage can be indicative of a lighting brightness, and a sensed current can be indicative of a number of lighting elements.

Figure 5:
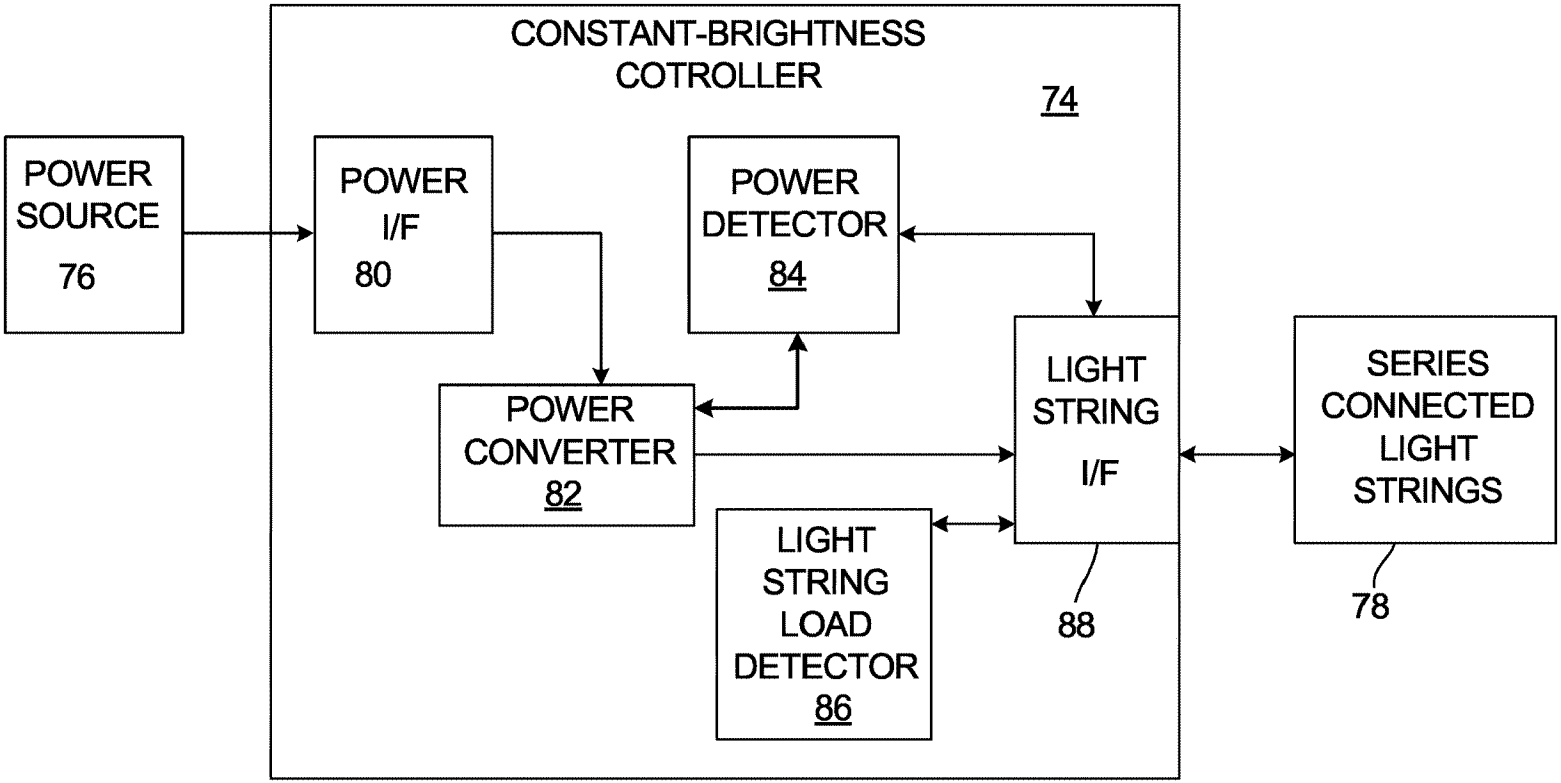
FIG. 5 is a block diagram of an embodiment of a light string power controller.

FIG. 5 is a block diagram of an embodiment of a light string power controller. In FIG. 5, constant-brightness controller 74 draws operating power from power source 76 and provides lighting power to series-connected light string(s) 78. Constant-brightness controller 74 includes power interface 80, power converter 82, power detector 84, light-string load detector 86, and light-string interface 88. Series-connected light string(s) 78 is electrically connected to power detector 84, power converter 82 and light string load detector 86 via light string interface 88. In some embodiments, light string interface 88 is a wired interface and series-connected light string(s) 78 is fixedly and electrically coupled to constant-brightness controller 74. In such an embodiment, series-connected light string(s) 78 can have an electrical connector at a distal end configured to couple to additional light strings, for example. In other embodiments, light string interface 88 is an electrical connector configured to removably couple to series-connected light string(s) 78.

Light-string load detector 86 is configured to provide a load-query signal to series-connected light string(s) 78. Series-connected light string(s) 78 receives the load-query signal and provides a load-response signal in response to the received load-query signal. The load-response signal is indicative of a power level corresponding to an illumination value of series-connected light string(s) 78. For example, if series-connected light string(s) 78 includes only one light string, then the load-response signal is indicative of a power level corresponding to the power that will cause each of the lighting elements of the one light string to illuminate at the illumination value indicated by the load-response signal. If, however, series-connected light string(s) 78 includes more than one light string, then the load-response signal will be indicative of a power level corresponding to the power that will cause each of the lighting elements of the more than one light string to illuminate at the illumination value indicated by the load-response signal.

Power detector 84 senses the power provided by power convertor 82 and provided to series-connected light string(s) 78 via light string interface 88. Power detector 84 also generates a signal indicative of the sensed power level provided to series-connected light string(s) 78. Power converter 82 then compares the signal indicative of the sensed power level with the power level indicated by the load-response signal. Power converter 82 controls the power provided to series-connected light string(s) 78 so as to be substantially equal to the power level indicated by the load-response signal. In some embodiments the power provided to series-connected light string(s) 78 can be within plus or minus 10% or within plus or minus 5% of the power level indicated by the load-response signal.

Power converter 82 receives operating power from power source 76 via power interface 80. In some embodiments, power interface 80 can be a wired interface and power source 76 can be fixedly and electrically coupled to constant-brightness controller 74. In other embodiments, power interface 80 can be an electrically connector configured to removeably coupled to power source 76. In either of these embodiments, power source 76 can be an electrical power converter, such as an AC to DC converter and/or a battery source.

In some embodiments, the operating power received, via power interface 80, can have a voltage operating range between a minimum operating voltage and a maximum operating voltage. Power converter 82 can be configured to provide power to series-connected light string(s) 78 at the power level indicated by the detected load-response signal while drawing operating power within the voltage operating range, wherein a ratio of the maximum operating voltage to the minimum operating voltage is greater than eight or ten. Power converter 82 can provide a constant power, as indicated by the detected load-response signal, independent of the voltage of the received operating power.

Figure 6:
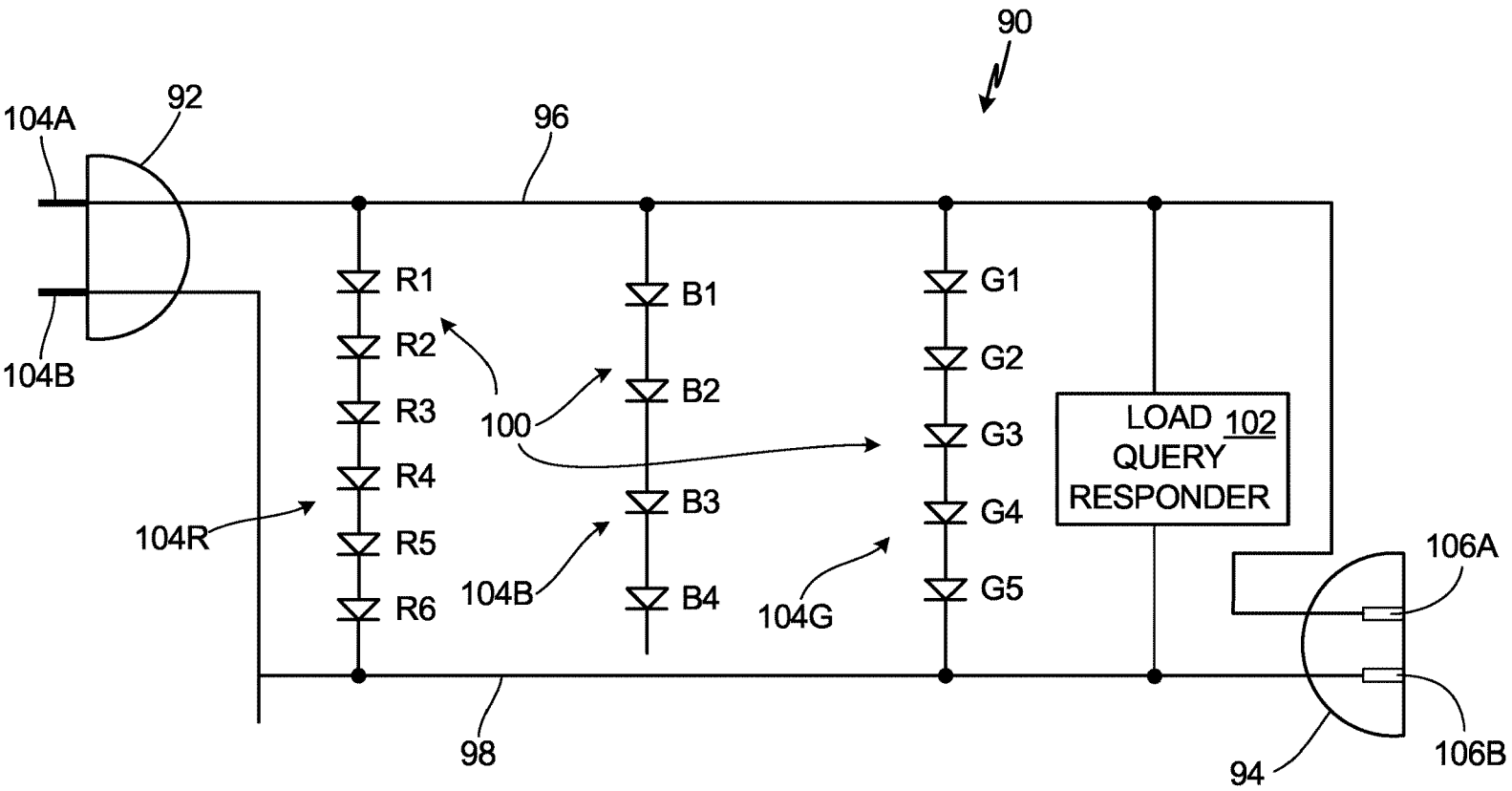
FIG. 6 is a schematic diagram of an embodiment of a decorative light string for use with a constant-brightness decorative lighting system.

FIG. 6 is a schematic diagram of an embodiment of a decorative light string for use with a constant-brightness decorative lighting system. In FIG. 6, decorative light string 90 includes first electrical connector 92, second electrical connector 94, first conductor 96, second conductor 98, plurality of lighting elements 100, and load-query responder 102. First electrical connector 92 has first and second contacts 104A and 104B. First electrical connector 92 is configured to receive power from a power source connected thereto via first and second contacts 104A and 104B. Second electrical connector 94 has first and second contacts 106A and 106B. Second electrical connector 94 is configured to provide power to other light strings connected thereto via first and second contacts 106A and 106B.

Conductor 96 is electrically coupled to and extends between first contact 104A of first electrical connector 92 and first contact 106A of second electrical connector 94. Conductor 98 is electrically coupled to and extends between second contact 104B of first electrical connector 92 and second contact 106B of second electrical connector 94. Conductors 96 and 98 conduct power received via first electrical connector 92 to power provided via second electrical connector 98 as well as delivering operating power to plurality of lighting elements 100.

Individual lighting elements of plurality of lighting elements 100 are distributed along decorative light string 90 and are configured to receive operating power via first and second conductors 96 and 98. In the depicted embodiment, plurality of lighting elements 100 is arranged in series-parallel fashion. Series-wired lighting elements 104R, 104B, and 104G are wired in parallel via conductors 96 and 98. Series-wired lighting elements 104R include six red LEDs $R_1$, $R_2$, $R_3$, $R_4$, $R_5$ and $R_6$. Series-wired lighting elements 104B include four blue LEDs $B_1$, $B_2$, $B_3$, and $B_4$. Series-wired lighting elements 104G include five green LEDs $G_1$, $G_2$, $G_3$, $G_4$, and $G_5$. A voltage drop across each of red LEDs $R_1$, $R_2$, $R_3$, $R_4$, $R_5$ and $R_6$ results from a current provided to series-wired lighting elements 104R. Similarly, voltage drops across each of blue LEDS $B_1$, $B_2$, $B_3$, and $B_4$ result from a current provided to series-wired lighting elements 104B. Voltage drops across each of green LEDS $G_1$, $G_2$, $G_3$, $G_4$, and $G_5$ result from a current provided to series-wired lighting elements 104G.

An applied voltage across conductors 96 and 98 will cause currents to flow in each of series-wired lighting elements 104R, 104B, and 104G. The number of LEDs in each of series-wired lighting elements 104R, 104B, and 104G can be selected to cause individual lighting elements $R_1$, $R_2$, $R_3$, $R_4$, $R_5$, $R_6$, $B_1$, $B_2$, $B_3$, $B_4$, $G_1$, $G_2$, $G_3$, $G_4$ and $G_5$ to have a desired current flowing therethrough. The current flowing through each of series-wired lighting elements 104R, 104B, and 104G corresponds to a brightness of individual lighting elements $R_1$, $R_2$, $R_3$, $R_4$, $R_5$, $R_6$, $B_1$, $B_2$, $B_3$, $B_4$, $G_1$, $G_2$, $G_3$, $G_4$ and $G_5$. In some embodiments, the number of series-connected lighting elements is selected to normalize the brightness of the differently colored elements. Red LED R1, for example might require a 0.7V drop across it for a desired brightness level, while blue LED B1 might require a 0.95V drop across it for the corresponding desired brightness level.

Load query responder 102 is connected between conductors 96 and 98. Load query responder 102 can be configured to receive a load-query signal (e.g., from constant-brightness controller 74 depicted in FIG. 5) and to provide a load-response signal in response to the received load-query signal. The load-response signal can be indicative of a power level corresponding to an illumination value of the plurality of lighting elements. In some embodiments, load query responder 102 includes a capacitor. In such an embodiment, the capacitance of load query responder 102 can be indicative of the number of lighting elements in decorative light string 90, for example.

As more light strings are connected to one another, each of which having load query responder 102 sized to indicate the number of lighting element therein, the total capacitance between conductors 96 and 98 increases. Constant-brightness controller 74 can determine the total number of lighting elements by measuring the total capacitance between conductors 96 and 98. For example, constant-brightness controller 74 can generate a small-signal AC voltage on conductors 96 and 98. The capacitance of load-query responders 102 then draw a small-signal AC current in response to the supplied small-signal AC voltage. Constant-brightness controller 74 can then detect and/or measure the AC current conducted, via conductors 96 and 98, to determine the total load of the series-connected light strings.

In some embodiments, load-query responder 102 can be a resistor. In such an embodiment, a small voltage, below a level which causes the lighting elements to conduct significant current, can be applied across conductors 96 and 98. The conducted current response can then indicate to constant-brightness controller 74 a power level corresponding to an illumination value of the one or more connected decorative light strings.

In some embodiments, the load-query signal is generated at a start-up time. In some embodiments, the load-query signal is generated if constant-brightness controller 74 detects a change in the electrical load connected thereto. In some embodiments, the constant brightness controller periodically generates the load-query signal.

Figure 7:
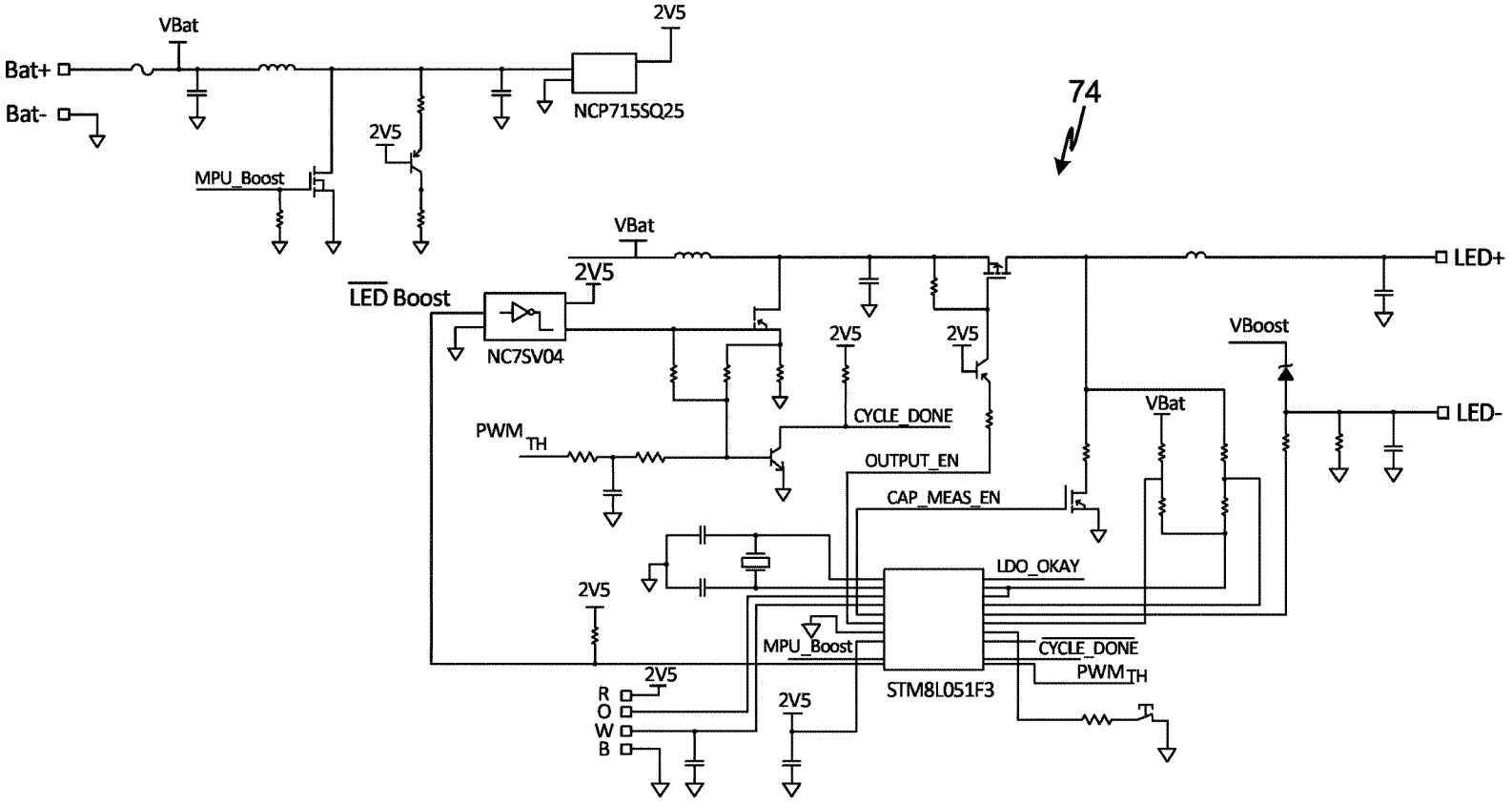
FIG. 7 is a circuit schematic diagram of an exemplary constant-brightness decorative lighting system.

FIG. 7 is a circuit schematic diagram of an exemplary constant-brightness decorative lighting system. In FIG. 7, constant-brightness controller 74 includes input voltage converter 104, and output voltage converter 106. Input voltage converter 104 receives operating power via input pins J2 and J3. The received operating power can have a voltage over a broad range. For example, in the depicted embodiment, the power source can be between 2 and 9 series connected NiMH batteries, each of which can deliver power between 1.5 volts down to 0.8 volts. Thus, the input voltage range can be between 1.6 volts up to 13.5 volts, for example. Such a voltage range has a dynamic range of greater than eight to one. In other embodiment, even higher dynamic ranges can be obtained. The received operating power is then converted by voltage regulator U2 to an internal operating voltage (e.g., 2.5 volts).

Output voltage converter 104 converts the received power from the internal operating voltage level to a level indicated a query-response signal received by one or more connected light strings attached to pins J4 and J5. In the depicted embodiment, a capacitance between pins J4 and J5 is measured to determine the query-response signal. The measured query-response signal is indicative of a power level corresponding to a desired brightness level for the attached one or more connected light strings. A measurement of the actual power delivered to the one or more connected light strings attached to pins J4 and J5 is also measured. Power controller U1 then compares the actual power delivered to the one or more connected light strings with the power level corresponding to the desired brightness level indicated by the query response signal. Power controller U1 then adjusts the actual power delivered to the one or more connected light strings connected via pins J4 and J5 so as to match the power level corresponding to the desired brightness level indicated by the query response signal.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A system for providing constant-brightness to light elements of one or more connected decorative light strings, the system comprising:

a light-string load detector configured to:

provide, via an electrically-conductive path, a load-query signal to the one or more connected light strings; and detect, via the electrically-conductive path, a load-response signal from the one or more connected decorative light strings, the load-response signal being indicative of a power level corresponding to an illumination value of the one or more connected decorative light strings; and a power converter configured to:

draw operating power from a power source; and provide, via the electrically-conductive path, power to the one or more connected decorative light strings, the power being provided at the power level indicated by the detected load-response signal, wherein the power converter includes a power detector conductively coupled to the electrically-conductive path and configured to:

sense the power level provided to the one or more connected decorative light strings; and generate a signal indicative of the sensed power level provided to the one or more connected decorative light strings.

2. The system of claim 1, further comprising:

a first of the one or more connected light strings electrically coupled, at a proximate end, to the light-string load detector; and a light-string connector mechanically and electrically coupled to a distal end of the first of the one or more connected light strings, the light-string connector configured to mechanically and conductively couple to a second of the one or more connected light strings.

3. The system of claim 1, wherein the electrically conductive path includes:

a light-string connector conductively coupled to both the light-string load detector and the power converter, the light-string connector configured to mechanically and conductively couple to a first of the one or more connected light strings.

4. The system of claim 1, further comprising:

a power connector configured to electrically couple to the power source.

5. The system of claim 1, wherein the operating power has a voltage operating range between a minimum operating voltage and a maximum operating voltage, wherein the power converter is configured to provide power to the one or more series-connected decorative light strings at the power level indicated by the detected load-response signal while drawing operating power within the voltage operating range, wherein a ratio of the maximum operating voltage to the minimum operating voltage is greater than eight.

6. The system of claim 1, wherein the load-response signal increases with an increasing number of decorative light strings connected to the one or more connected decorative light strings.

7. The system of claim 1, wherein the power converter further includes:

a switching supply configured to draw operating power from the power source and to provide power to the one or more connected decorative light strings, wherein the switching supply adjusts the provided power such that the signal indicative of the sensed power level provided to the one or more connected decorative light strings is within plus or minus 10% of a power level indicated by the detected load-response signal.

8. The system of claim 1, wherein the power converter further includes:

a switching supply configured to draw operating power from the power source and to provide power to the one or more connected decorative light strings, wherein the switching supply adjusts the provided power such that the signal indicative of the sensed power level provided to the one or more connected decorative light strings is within plus or minus 5% of a power level indicated by the detected load-response signal.

9. The system of claim 1, further comprising:

the power source electrically coupled to the power converter, wherein the power source is configured to convert AC power to DC power.

10. The system of claim 1, wherein the power source is one or more batteries, the system further comprising:

a battery container conductively coupled to the power converter, the battery container configured to receive the one or more batteries.

11. A decorative light string configured for use with a modular constant-brightness lighting system, the decorative light string comprising:

a first electrical connector located at a first end of the decorative light string, the first electrical connector having first and second contacts, wherein the first electrical connector is configured to receive power via the first and second contacts of the first electrical connector;

a second electrical connector at a second end of the decorative light string, the second electrical connector having first and second contacts, wherein the second electrical connector is configured to provide power via the first and second contacts of the second electrical connector;

a first conductor electrically coupled to and extending between the first contact of the first electrical connector and the first contact of the second electrical connector;

a second conductor electrically coupled to and extending between the second contact of the first electrical connector and the second contact of the second electrical connector;

a plurality of lighting elements distributed along the decorative light string and configured to receive operating power via the first and second conductors; and a load-query responder electrically connected between the first and second conductors, the load-query responder configured to receive a load-query signal and to provide a load-response signal in response to the received load-query signal, the load-response signal being indicative of a power level corresponding to an illumination value of the plurality of lighting elements.

12. The decorative light string of claim 11, wherein the plurality of lighting elements are wired in series-parallel fashion between the first and second conductors.

13. The decorative light string of claim 12, wherein the series-parallel fashion includes a plurality of series-wired strings of lighting elements, each electrically connected between the first and second conductors.

14. The decorative light string of claim 12, wherein the plurality of series-wired strings of lighting elements include:

a first series-wired string having a first number of lighting elements of a first color; and a second series-wired string having a second number of lighting elements of a second color different from the first color.

15. The decorative light string of claim 14, wherein the first number of lighting elements is different from second number of lighting elements so that a first brightness of the first series-wired string is substantially equal to a second brightness of the second series-wired string.

16. The decorative light string of claim 14, wherein each of the first number of lighting elements and the second number of lighting elements is such that when power is provided thereto at the power level corresponding to the illumination value of the plurality of lighting elements as indicative load-response signal, the brightness of each of the first and second series-wired stings corresponds to the illumination value.

17. The decorative light string of claim 11, wherein the load-query responder is a capacitor having a capacitance value indicative of the desired power level corresponding to a predetermined illumination value of the plurality of lighting elements.

18. The decorative light string of claim 11, wherein the load-query responder is a resistor having a resistance value indicative of the desired power level corresponding to a predetermined illumination value of the plurality of lighting elements.

19. A battery module comprising:

a battery receiver configured to receive one or more batteries;

an input power connector configured to mechanically and electrically couple to an upstream battery module in a series fashion; and an output connector configured to mechanically an electrically couple to either a downstream battery module in a series fashion or to a modular constant-brightness lighting system, wherein, if the battery module is connected to the modular constant-brightness lighting system, power is provided to the constant-brightness light controller, the provided power having a voltage equal to the sum of voltages provided by connected upstream battery modules and voltage of the battery module connected to the modular constant-brightness lighting system.

* * * * *